US007231679B2

(12) United States Patent
Ho

(10) Patent No.: US 7,231,679 B2
(45) Date of Patent: Jun. 19, 2007

(54) BEDDING ASSEMBLY

(75) Inventor: Stanley Ho, Warren, NJ (US)

(73) Assignee: Allure Home Creation Co., Inc., Boonton, NJ (US)

( * ) Notice: Subject to any disclaimer, the term of this patent is extended or adjusted under 35 U.S.C. 154(b) by 0 days.

(21) Appl. No.: 11/285,876

(22) Filed: Nov. 23, 2005

(65) Prior Publication Data

US 2007/0113341 A1 May 24, 2007

(51) Int. Cl.
*A47G 9/02* (2006.01)

(52) U.S. Cl. ..... 5/497; 5/482; 5/499; 5/500; 5/502

(58) Field of Classification Search ..... 5/497, 5/482, 485, 494, 499, 500, 502
See application file for complete search history.

(56) References Cited

U.S. PATENT DOCUMENTS

| | | | | |
|---|---|---|---|---|
| 3,258,789 A | | 7/1966 | Banks | 5/485 |
| 3,962,739 A | | 6/1976 | Crockett | 5/497 |
| 4,035,854 A | * | 7/1977 | Pardee | 5/497 |
| 4,266,308 A | * | 5/1981 | Shatz | 5/494 |
| 4,384,380 A | | 5/1983 | Glaha et al. | 5/485 |
| 4,924,543 A | * | 5/1990 | Hoss et al. | 5/484 |
| 5,375,274 A | * | 12/1994 | Cuneo | 5/497 |
| 5,729,847 A | * | 3/1998 | Allardice | 5/502 |
| 5,794,285 A | * | 8/1998 | Burch | 5/497 |
| 5,901,389 A | | 5/1999 | Manner | 5/497 |
| 6,061,851 A | | 5/2000 | Crowell | 5/497 |
| 6,088,852 A | | 7/2000 | Quandt | 5/482 |
| 6,108,836 A | | 8/2000 | Keene, III | 5/497 |
| 6,122,783 A | | 9/2000 | Herndon et al. | 5/496 |
| 6,134,730 A | | 10/2000 | Evanson | 5/482 |
| 6,725,477 B2 | | 4/2004 | Ciaglia et al. | 5/497 |
| 6,859,962 B2 | | 3/2005 | Diak/Ghanem | 5/499 |
| 6,886,197 B1 | | 5/2005 | Madigan | 5/482 |
| 7,140,053 B1 | * | 11/2006 | Mangano | 5/493 |
| 2003/0037374 A1 | | 2/2003 | Ciaglia et al. | 5/497 |

FOREIGN PATENT DOCUMENTS

GB 2219740 A * 12/1989

* cited by examiner

*Primary Examiner*—Robert G. Santos
(74) *Attorney, Agent, or Firm*—Frommer Lawrence & Haug LLP

(57) ABSTRACT

A bedding assembly including at least one fitted sheet having a head end and a foot end for covering a mattress at least one flat sheet having a head end and a foot end for covering said fitted sheet, and stitches connecting the fitted sheet to the flat sheet along at least one edge of the foot end of the fitted sheet.

4 Claims, 3 Drawing Sheets

BEDDING ASSEMBLY

CROSS-REFERENCE TO RELATED APPLICATION

This application is related to a commonly owned application Ser. No. 11/285,877 entitled "Bedding Assembly and Comforter Fastener," filed Nov. 23, 2005, and provisional application Ser. No. 60/743,131 filed Nov. 7, 2005, the disclosures of which are incorporated herein by reference.

FIELD OF THE INVENTION

The present invention relates, in general, to a bedding assembly and means for maintaining the bedding assembly on a bed while in use and for simplifying bed making.

BACKGROUND

Various specific types and designs of bedclothes, commonly including various covering (as sheets, comforters, bed skirts, pillow cases) used on a bed, are known to those skilled in the art. However, it is often the case that when in use these bedclothes slip off of the bed resulting in a chilling of the user, or when not in use once these items have slipped off of the bed there are additional challenges necessary to re-make the bed. When using typical bedclothes, each separate piece is put on the bed one at a time.

Bed covering designs and arrangements in common use have remained largely unchanged for many years, and generally involve the use of a bottom sheet to cover the mattress, a top sheet to cover a sleeper lying on the bottom sheet, and additional blankets or coverings placed above the top sheet when needed or desired. Fitted bottom sheets, with a pocket at each corner to fit around and under the mattress, have been known for some time and have become the conventional design because they are easily installed and removed, and because they stay in place much more reliably than flat sheets. In the conventional approach, however, separate flat top sheet have continued to be the norm, despite disadvantages and problems with their use. Those disadvantages and problems include difficulty in properly aligning the top sheet on the mattress; difficulty in tucking the ends and edges of the top sheet under the mattress, especially when the bed is placed with one side against a wall or access to one side is otherwise obstructed; and difficulty in maintaining the position and attachment of the top sheet during use.

The present invention addresses the shortcomings of the prior art and the conflicting criteria of typical users.

SUMMARY OF THE INVENTION

It is the object of the present invention to overcome the shortcomings of the prior art preforms discussed above.

One aspect of the present invention is directed to a bedding assembly including at least one fitted sheet having a head end and a foot end for covering a mattress, and at least one flat sheet having a head end and a foot end for covering said fitted sheet, and stitches connecting the fitted sheet to the flat sheet along at least one edge of the foot end of the fitted sheet.

Another aspect of the present invention is directed to a method of making a bed including the steps of providing a bedding assembly including at least one fitted sheet having a head end and a foot end for covering a mattress, at least one flat sheet having a head end and a foot end for covering said fitted sheet, and stitches connecting the fitted sheet to the flat sheet along at least one edge of the foot end of the fitted sheet. The method further includes steps of overlaying the mattress with the flat sheet and fitted sheet combination, and affixing the fitted sheet to the mattress, so as to secure the fitted sheet flat sheet combination in an aesthetically pleasing arrangement.

In this text, the terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated in the accompanying drawings in which corresponding components are identified by the same reference numerals.

BRIEF DESCRIPTION OF THE DRAWINGS

In the following detailed description of the invention, reference will be made to the accompanying drawings, incorporated herein by reference, wherein.

DETAILED DESCRIPTION

Figure 1:
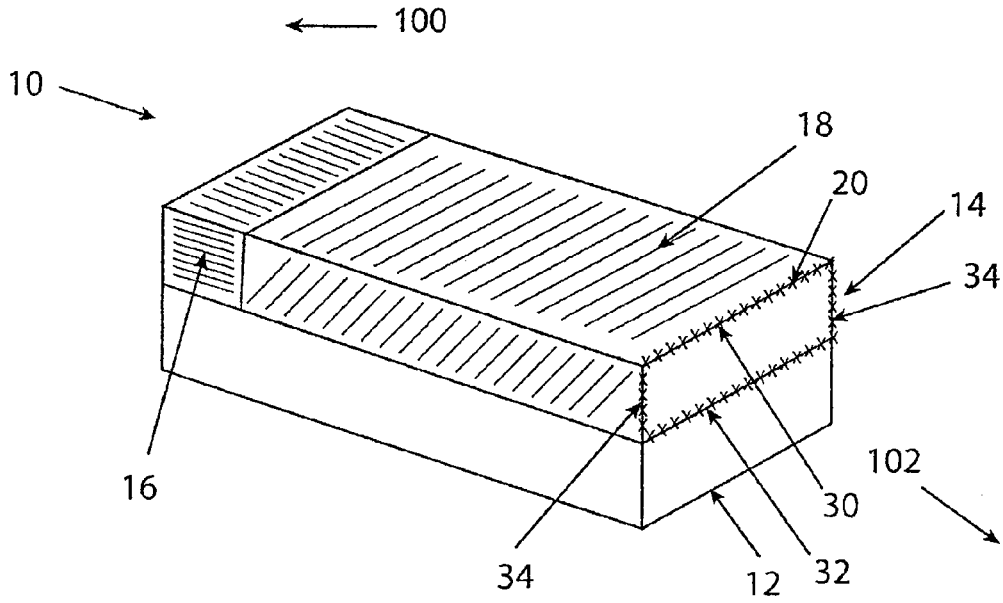
FIG. 1 is a perspective view of one aspect of the present invention.

An example of the present invention can be found in FIG. 1, where a perspective view of a typically bed 10 having a head and 100 and a foot end 102 can be seen. The bed 10 includes a mattress 14 and a box spring 12. The mattress 14 is covered with a fitted sheet 16, over which is a top or flat sheet 18. As shown in FIG. 1, at the foot end 102, the top sheet 18 and the fitted sheet 16 are joined. The three remaining ends, namely the head end 100 and the two sides are free and allow for movement. In some arrangements it may be desirable that one of the sides also be attached to the fitted sheet 16, as will be discussed below.

As shown in FIG. 1 the top sheet 18 is sewn to the fitted sheet 16 along four edges, namely the top horizontal edge 30, a bottom horizontal edge 32, and the two vertical side edges 34. This demonstrated in the figure by stitches 20. The stitches 20 secure the top sheet 18 to the fitted sheet 16 and insure that at least on the foot end 102 of the bed 10, the flat sheet will be secured. It has been found that securing the foot end 102 of the flat sheet 18 generally enhances the likelihood that the flat sheet 18 will not be kicked off of the bed 10 while the user is sleeping. In addition, the flat sheet 18 as shown in FIG. 18 is much easier than traditional flat sheets to secure to the bed when making it as it is already secured to the fitted sheet 16 in the location where traditional hospital corners would be installed at the foot end 102 of the bed 10.

Figure 5:
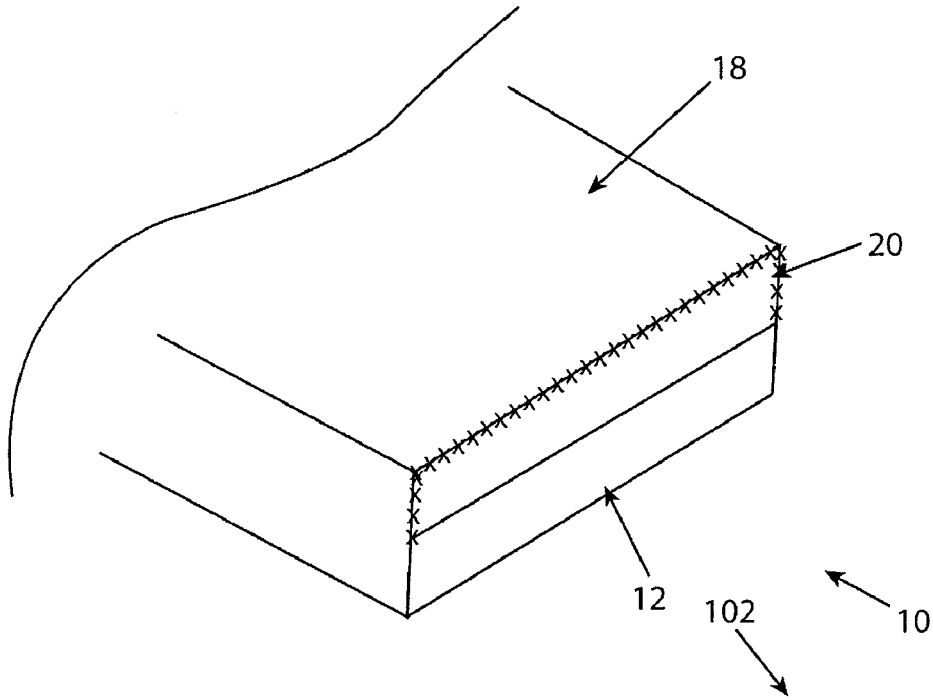
FIG. 5 is a perspective view of a fifth aspect of the present invention.

It has been determined that to improve security of the top sheet 18 on the fitted sheet 16, at least two of the edges 30–34 must be sewn. Preferably, the edges that are sewn are adjacent edges and not parallel edges. More preferably still, at least three edges are sewn to insure strength to the combination of the fitted and the top sheets 16 and 18, as shown in FIG. 5.

Figure 2:
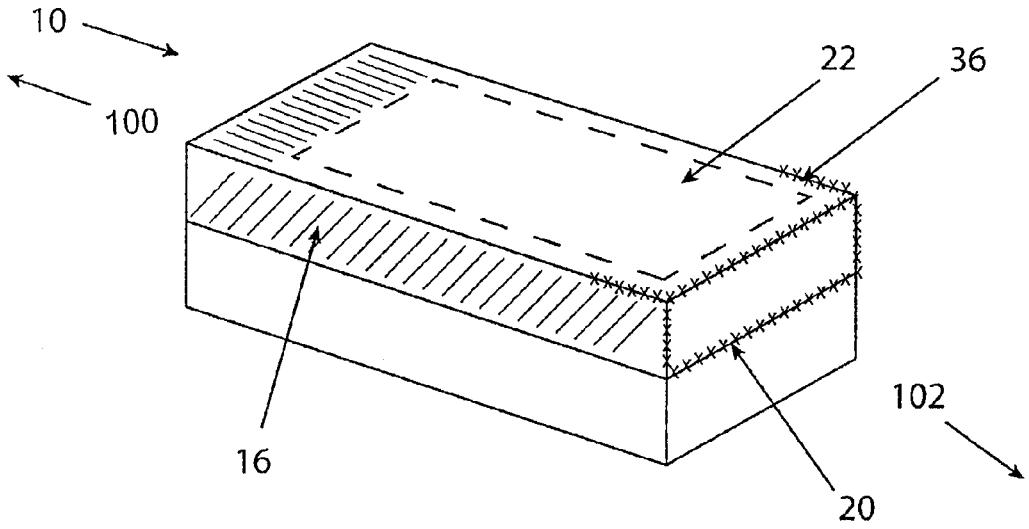
FIG. 2 is a perspective view of a second aspect of the present invention.

In FIG. 2 a second aspect of the present invention is shown. In FIG. 2, the flat sheet 18 is formed so that it only covers the top surface of the fitted sheet 16. Such an arrangement has the advantage of reducing the bulk of the material hanging over the edge of the mattress and may enhance the aesthetic appeal of the bed 10 when made. Another feature of the aspect of the present invention shown in FIG. 2 is the addition of stitches 20 on the side 36 of the mattress. These stitches 20 on the side 36 of the mattress further assist in securing the flat sheet 18 to the fitted sheet 16, and reduce the likelihood that the user would kick the flat sheet 18 off of the bed when in use. Although shown in FIG. 2 as having all four edges 30–34 of the flat sheet 18 sewn to the fitted sheet 16, this need not be the case. As discussed above, sewing of at least one edge is necessary, and preferably two or more edges are sewn. Further, there is no requirement that the entire edge be sewn, as will be described below.

Figure 3:
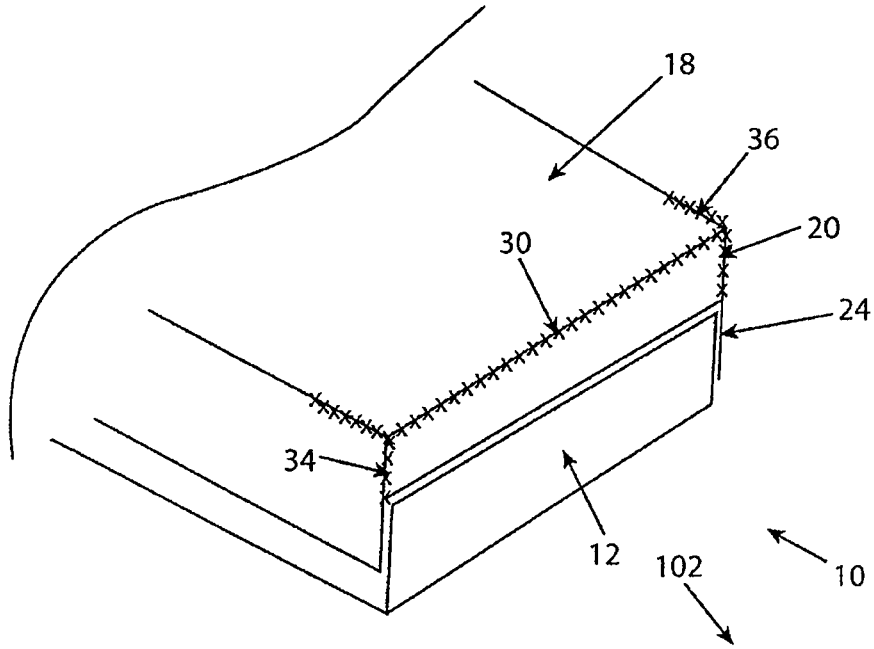
FIG. 3 is a perspective view of a third aspect of the present invention.

In FIG. 3, a further aspect of the present invention is shown. The mattress in FIG. 3 is covered with a fitted sheet which itself is covered with a flat sheet 18. The flat sheet 18 is sewn to the fitted sheet on three edges 30 and 34. In addition, the flat sheet 18 is sewn on two lengthwise edges 36. The flat sheet 18 also includes flaps 24 which extend over the mattress and at least partially cover the box spring 12.

Figure 4:
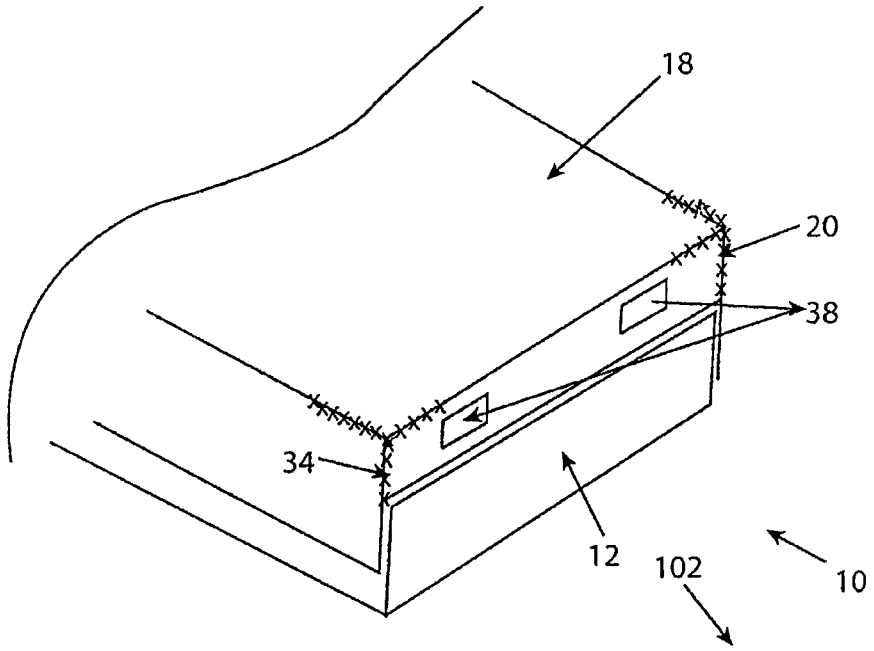
FIG. 4 is a perspective view of a fourth aspect of the present invention.

Yet a further aspect of the present invention is shown in FIG. 4. FIG. 4 depicts a flat sheet 18 sewn to a fitted sheet along only a portion of the horizontal edge 30. Specifically, FIG. 4 shows stitches 20 along the portion of horizontal edge 30 that is closest to the corners of the bed. Accordingly, it is not necessary that an entire edge surface of the flat sheet 18 be stitched to the fitted sheet. As shown if FIG. 4 only portions of the edges 36 are sewn as is only a portion of the horizontal edge 30. Though shown as having the entirety of vertical edges 34 sewn together, those of skill in the art will appreciate that only a portion of these vertical edges need be sewn. A further aspect of the present invention are the two attachment means 38. The use of these attached means described in greater detail in commonly owned U.S. patent application entitled "Comforter Fastener" filed Nov. 7, 2005, which is incorporated herein by reference, and where it is described that the attachment means 38 may be for, example, hook and loop fasteners sold under the trade name Velcro®. Alternatively, the attachment means could be buttons, snaps, zippers, or other useful means known to those of skill in the art. Further, corresponding attachments means may be formed on a comforter or a duvet cover that covers the comforter. Through the use of the attachment means 38, the comforter is secured to the bed 10. When used in combination with the sewn together fitted and flat sheets 16 and 18, described above, the comforter provides a warm, comfortable and secure combination of sheets and comforters when in use, and when not in use a comforter and sheet combination that is aesthetically appealing and held in place when made up on a bed.

Having thus described in detail preferred embodiments of the present invention, it is to be understood that the invention defined by the above paragraphs is not to be limited to particular details set forth in the above description, as many apparent variations thereof are possible without departing from the spirit or scope of the present invention.

I claim:

1. A bedding assembly comprising:

at least one fitted sheet having a head end and a foot end for covering a mattress;

at least one flat sheet having a head end and a foot end for covering said fitted sheet;

stitches connecting the at least one fitted sheet to the at least one flat sheet at least partially along top horizontal edge of the foot end of the at least one fitted sheet;

stitches connecting the at least one fitted sheet to the at least one flat sheet at least partially along a bottom horizontal edge of the foot end of the at least one fitted sheet;

stitches connecting the at least one fitted sheet to the at least one flat sheet at least partially along each top lengthwise edge at the foot end of the at least one fitted sheet; and stitches connecting the at least one fitted sheet to the at least one flat sheet at least partially along each vertical edge of the foot end of the at least one fitted sheet.

2. The bedding assembly of claim 1, wherein the at least one flat sheet includes flaps extending below the mattress.

3. The bedding assembly of claim 1, wherein the at least one flat sheet extends only to the edge of the at least one fitted sheet.

4. A method of making a bed comprising the steps of:

providing a bedding assembly including at least one fitted sheet having a head end and a foot end for covering a mattress, at least one flat sheet having a head end and a foot end for covering said at least one fitted sheet, wherein said at least one flat sheet is sewn to said at least one fitted sheet at least partially along; a top horizontal edge of the foot end of the at least one fitted sheet; a bottom horizontal edge of the foot end of the at least one fitted sheet; each top lengthwise edge at the foot end of the at least one fitted sheet; and each vertical edge of the foot end of the at least one fitted sheet;

overlaying the mattress with the flat sheet and fitted sheet combination; and affixing the at least one fitted sheet to the mattress, so as to secure the at least one fitted sheet and flat sheet combination in an aesthetically pleasing arrangement.

* * * * *